United States Patent [19]

Di Maio et al.

[11] 4,047,281

[45] Sept. 13, 1977

[54] METHOD OF SETTING BLIND RIVETS

[75] Inventors: Anthony E. Di Maio; Joseph G. Todisco, both of Georgetown, Mass.

[73] Assignee: Marson Corporation, Chelsea, Mass.

[21] Appl. No.: 715,002

[22] Filed: Aug. 17, 1976

Related U.S. Application Data

[62] Division of Ser. No. 581,954, May 28, 1975, Pat. No. 4,005,519.

[51] Int. Cl.[2] ..... B23P 19/00

[52] U.S. Cl. ..... 29/429; 29/509; 29/522

[58] Field of Search ..... 29/429, 509, 512, 522, 29/818, 788, 283.5, 243.54

[56] References Cited

U.S. PATENT DOCUMENTS

| | | | |
|---|---|---|---|
| 3,048,296 | 8/1962 | Heidenwolf | 29/816 X |
| 3,270,545 | 9/1966 | Jackes et al. | 29/283.5 X |
| 3,606,661 | 9/1971 | Schoepe et al. | 29/788 X |
| 3,727,294 | 4/1973 | Caller | 29/429 |
| 3,763,541 | 10/1973 | Jaffe | 29/816 X |
| 3,797,096 | 3/1974 | Nilsson | 29/429 |

*Primary Examiner*—Charlie T. Moon

[57] ABSTRACT

An apparatus and method particularly adapted for use in continuously setting blind rivets having elongated mandrels in suitably apertured material. Such apparatus embodies support means, feed means operatively connected to the support means for selectively feeding individual rivets to a loading station; carriage means operatively connected to the support means including rivet holding assembly means for receiving respective ones of the rivets and being selectively and incrementally advanced from at least a loading station, to a working station, and back again to the loading station; drive means operatively connected to the carriage means for successively advancing the rivet holding assembly means from at least the loading station to the working station, and back again to the loading station; motion producing means for imparting predetermined generally vertical displacement to each of the rivet holding assembly means in response to movement of the holding assembly means between at least the loading and working stations, and rivet setting means for vertically displacing respective ones of the rivets operatively held by the holding assembly means at the working station to set the rivets in the apertured material. The method for enabling the continuous setting of a plurality of rivets comprises the steps of feeding individual rivets to respective ones of a plurality of rivet holding assemblies at a loading station, incrementally advancing the rivets in a first predetermined path such that they travel from at least the loading station to the working station, supporting the material to be riveted at the working station in a generally horizontal plane, such that the rivet is situated above the plane for insertion into the workpiece, displacing the respective ones of the rivets operatively held by the rivet holding assemblies in a second predetermined path such that the rivet carried thereby is set in the material which is to be riveted together.

5 Claims, 18 Drawing Figures

2
20
40
74
80
72
78
22
32
54
68
278
280
44
42
66
244
64
246
246
48
240
38
62
50
46
188
52
266
58
56
56
274
276
60
2

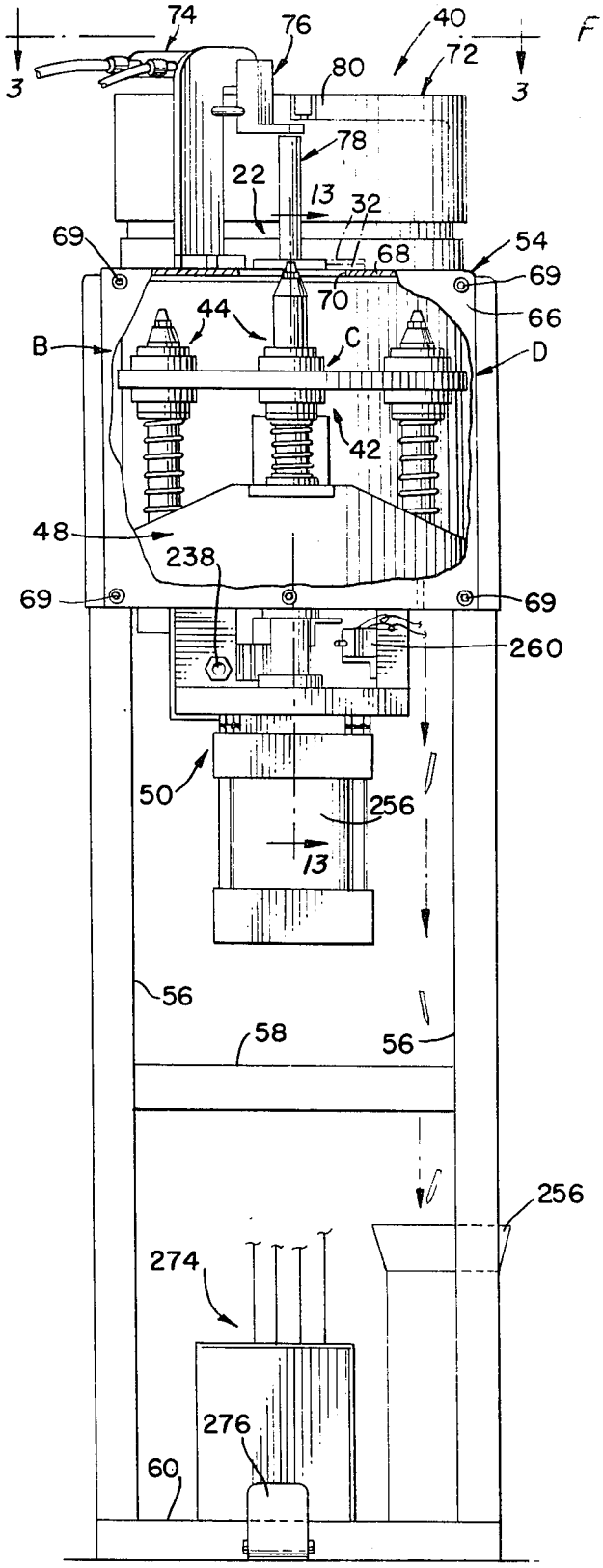
FIG 2
FIG. 3.
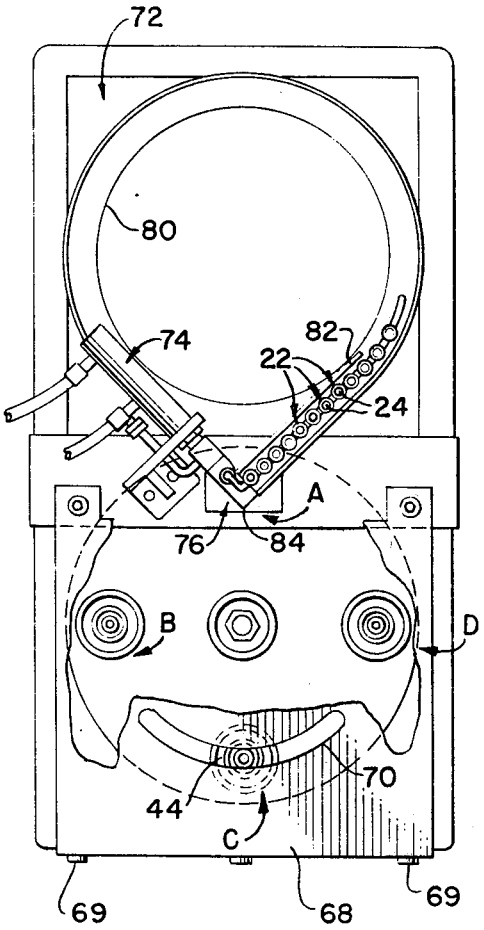

METHOD OF SETTING BLIND RIVETS

This is a divisional application of application Ser. No. 581,954, filed May 28, 1975, now U.S. Pat. No. 4,005,519.

BACKGROUND OF THE INVENTION

1. Field of the Invention

The present invention generally pertains to an apparatus and method for setting blind rivet type fasteners or the like. More particularly, it is directed to a novel and improved method and apparatus which enables the continuous setting of such blind rivets in a manner which promotes efficient and effective riveting on a production line basis.

2. Description of the Prior Art

Typically, blind rivet type fasteners are characterized by a flanged eyelet or outer rivet section which is connected to a generally elongated mandrel having a somewhat enlarged head portion at one end thereof which engages the eyelet portion. Ordinarily, this mandrel projects through the eyelet portion and is usually adapted to cooperate with an appropriate type of chuck assembly therefor. The eyelet portion, on the other hand, is normally arranged to slidably interfit with formed and aligned apertures in workpieces of material which are to be suitably riveted together. Generally, to effectuate a riveting action for such kind of rivet, the protruding portion or shank of the mandrel is subjected to a tensile force which is sufficient in magnitude to effectively pull the mandrel relative to the eyelet portion. During this pulling procedure, the mandrel head deforms the eyelet to form a second flange which is spaced away from a first flange formed on the eyelet while a segment of the mandrel eventually separates from the remainder thereof, thereby leaving the workpieces in a locked or riveted condition. The foregoing types of blind rivet fasteners find a relatively wide variety of industrial uses and are often utilized, for example, to effectively rivet together workpieces made of sheet metal or the like.

In this particular riveting field, there are several known mechanisms which are capable of setting such of the aforedescribed forms of blind rivets. The more conventional category of such mechanisms is a hand-held manually operated rivet setting apparatus. These types of mechanisms may be normally characterized as including two levers or tong arms which are pivotably moved relative to each other, wherein one of such arms includes a conventional chuck assembly for holding the mandrel of the blind rivet. To effect a riveting operation, the levers are appropriately manually operated, with some degree of physical effort, so as to operate the chuck assembly to rupture the rivet mandrel, thereby setting the rivet in the material.

Although the foregoing described type of mechanism performs satisfactorily in a number of work applications, it suffers certain shortcomings, whenever it is contemplated that such riveting be accomplished on an assembly or production line basis. As can be readily appreciated, for each riveting operation there must be a corresponding manual operation of the levers with both hands. In addition, after each individual rivet setting operation is performed, the mechanism must be reloaded with another blind rivet. Quite obviously, such a riveting operation would be a somewhat slow procedure for production rivet work. Aside from the shortcomings previously mentioned which are associated with this category of riveting mechanism, others which also exist are that they are not as versatile and are somewhat awkward in situations wherein it is desired to rivet multiple layers of workpieces which are ganged together, especially if each of such workpieces are to assume a specific angular orientation with respect to each other. As can be readily appreciated, it would be extremely difficult to insure and maintain the proper alignment of such several workpieces since both hands would be required to operate the mechanism to set the rivet. Additionally, it is believed evident from the foregoing description that this particular manner of riveting is at times awkward, and, or course, not as fast as would be desirable. Furthermore, such riveting operation would be made even more cumbersome if, for example, the pieces to be riveted were relatively heavy for the operator to easily handle or relatively awkward to conveniently manually grip. Such shortcomings have a tendency to require that an operator expend significantly more time and energy in riveting blind rivets by hand. Consequently, of course, a relatively considerable amount of time, effort and costs are required to be expended whenever completing a sizeable number of riveting operations, such as would be the case on a production line basis.

Other similar kinds of blind rivet setting mechanisms may be pneumatically actuated. In this particular manner, it is somewhat less strenuous for an operator to actuate the rivet setting mechanism. However, such pneumatic operated rivet setting mechanisms nonetheless suffer from the previously described disadvantages, such as having to be reloaded with new blind rivets after every operation, as well as the various difficulties attendant with handling and accurately aligning several workpieces which may be required to be ganged together with specific angular orientations relative to each other, and which further may be heavy and/or cumbersome.

Another known approach to improve upon the aforedescribed difficulties typically encountered in setting blind rivets is generally described in U.S. Pat. No. 3,101,858. In this particular patent, an automatic rivet setting apparatus is disclosed as utilizing a motor driven rotor member which carries a plurality of chucks for selectively receiving blind rivets which are automatically fed to them for subsequent rivet setting operations. Despite that the foregoing provides a certain degree of improvement over the previously described prior art mechanisms, it nonetheless suffers from similar as well as additional disadvantages. In the above-referenced patent, the rotor member which carries the rivet chuck assemblies is incrementally advanced in a generally vertical plane such that the chuck assemblies carrying each of the individual rivets is moved downwardly and toward the operator's body during a normal rivet setting operation. For instance, with the foregoing apparatus, it is relatively difficult for an operator to effectively rivet together workpieces because such workpieces normally have to be held by two hands held in front of the operator. Such working conditions, for example, make it rather difficult for effectively riveting several pieces which are ganged into multiple layers. Another somewhat difficult rivet setting operation to perform with this type of apparatus would be to align and maintain alignment of multiple layers through the use of two hands such that each of the layers are situated in a predetermined orientation. In addition, such apparatus is relatively complicated in construction and has relatively many moving parts. Therefore, there is an increased likelihood that such apparatus will be subject to more breakdowns and repairs.

Besides the foregoing disadvantages, if the workpieces are relatively heavy, large, or otherwise cumbersome to conveniently handle, the task of satisfactorily riveting such workpieces together would also be correspondingly relatively more difficult and time consuming.

Since, as previously observed, an operator working on such apparatus ordinarily stands immediately in front of the rotor, there might exist a likelihood that injury would occur should any portion of the operator's body or clothing inadvertently contact the moving rotor. For instance, the operator's leg might be struck by one of the chuck assemblies as the latter rotates downwardly, perhaps inflicting serious injury. From the foregoing description of this particular type of rivet setting apparatus, it is believed readily apparent that such apparatus is, as with the ones previously described, subject to several significant disadvantages; especially when considered from the standpoint of production work, wherein speed, ease of operation, and safety are important factors.

Consequently, heretofore known blind rivet setting mechanisms have in general failed to adequately enable the efficient and safe setting of blind type rivets, especially on a production line basis. Moreover, with such known forms of apparatus it is relatively difficult for a single operator to efficiently, accurately, and safely align several workpieces ganged together regardless of size, weight, or particular angular orientation in a convenient and reliable manner.

SUMMARY OF THE INVENTION

It is an object of the present invention to overcome the aforedescribed shortcomings typically associated with the heretofore known rivet setting mechanisms by providing a novel and improved method and apparatus which enables the selective and continuous setting of blind rivet fasteners in an efficient and effective manner, especially in situations wherein production line work is required.

Briefly stated, the instant invention contemplates a rivet setting apparatus which is especially adapted for use in enabling the continuous setting of blind rivets which have elongated mandrels in suitably apertured workpieces. Such apparatus essentially includes support means, feed assembly means, carriage means, drive means, motion producing means, and rivet setting means.

The support means has detachably connected thereto a work support surface which is disposed in a generally horizontal plane for enabling the convenient support and accurate alignment of, for example, several workpieces regardless of weight, size or particular angular orientation. The feed assembly means is operatively connected to the support means for selectively feeding individual blind rivets to a loading station. Operatively mechanically connected to the support means is the carriage means which basically includes a plurality of rivet holding assembly means. Each of the rivet holding assembly means is vertically situated adjacent the work support surface and is selectively, successively, and incrementally advanced from at least the loading station, whereat a rivet mandrel is respectively received by a rivet holding assembly means, to a working station, whereat the rivet holding assembly means is selectively generally vertically displaced by a distance which enables the blind rivet to be set in the apertured material, and back again to the loading station for completing one cycle of operation. In the present invention, the drive means is operatively connected to the carriage means for selectively, positively, and incrementally advancing each of the rivet holding assembly means from the loading station to the working station, and back again to the loading station. The motion producing means is operatively associated with each of the rivet holding assembly means for imparting a predetermined generally vertical displacement to each of the former in response to movement of such holding assembly means between the loading and the working stations, such that each of the blind rivets may be set. The rivet setting means may be selectively actuatable to appropriately displace each of the respective rivet holding assembly means whenever such are at the working station by a sufficient distance whereby a force is created which ruptures the rivet mandrel. In this particular manner, setting the rivet in the workpieces is accomplished. It should, of course, be emphasized that the materials to be riveted together are placed on the work support surface which support surface is so constructed to enable the workpieces to be operatively associated with the rivet.

The method which is envisioned for enabling the continuous setting of the blind rivets in the apertured workpieces basically comprises the steps of feeding individual rivets to respective ones of a plurality of rivet holding assemblies at a loading station, successively and incrementally advancing the rivet holding assemblies in a first predetermined path such that the rivets travel from at least the loading station to a working or setting station, displacing respective ones of the rivet holding assemblies at the working station in a second predetermined path which is generally transverse with respect to the first predetermined path such that the rivet is appropriately set within the workpieces, and supporting the material to be riveted in a generally horizontal plane at the working station such that the rivet is situated above the plane for enabling insertion into the workpieces.

BRIEF DESCRIPTION OF THE DRAWINGS

The above, as well as other objects, features, and advantages of the present invention shall become readily apparent upon a reading of the detailed description of the present invention when viewed in conjunction with the accompanying drawings wherein like reference numerals indicate like structure throughout the several views.

FIG. 2 is an end elevational view taken substantially along line 2—2 appearing in FIG. 1 looking in the direction of the arrows and further illustrating details of the rivet setting apparatus;

FIG. 3 is a plan view taken substantially along the line 3—3 appearing in FIG. 2 looking in the direction of the arrows and depicting further aspects of the rivet setting apparatus;

DETAILED DESCRIPTION

Figure 1:
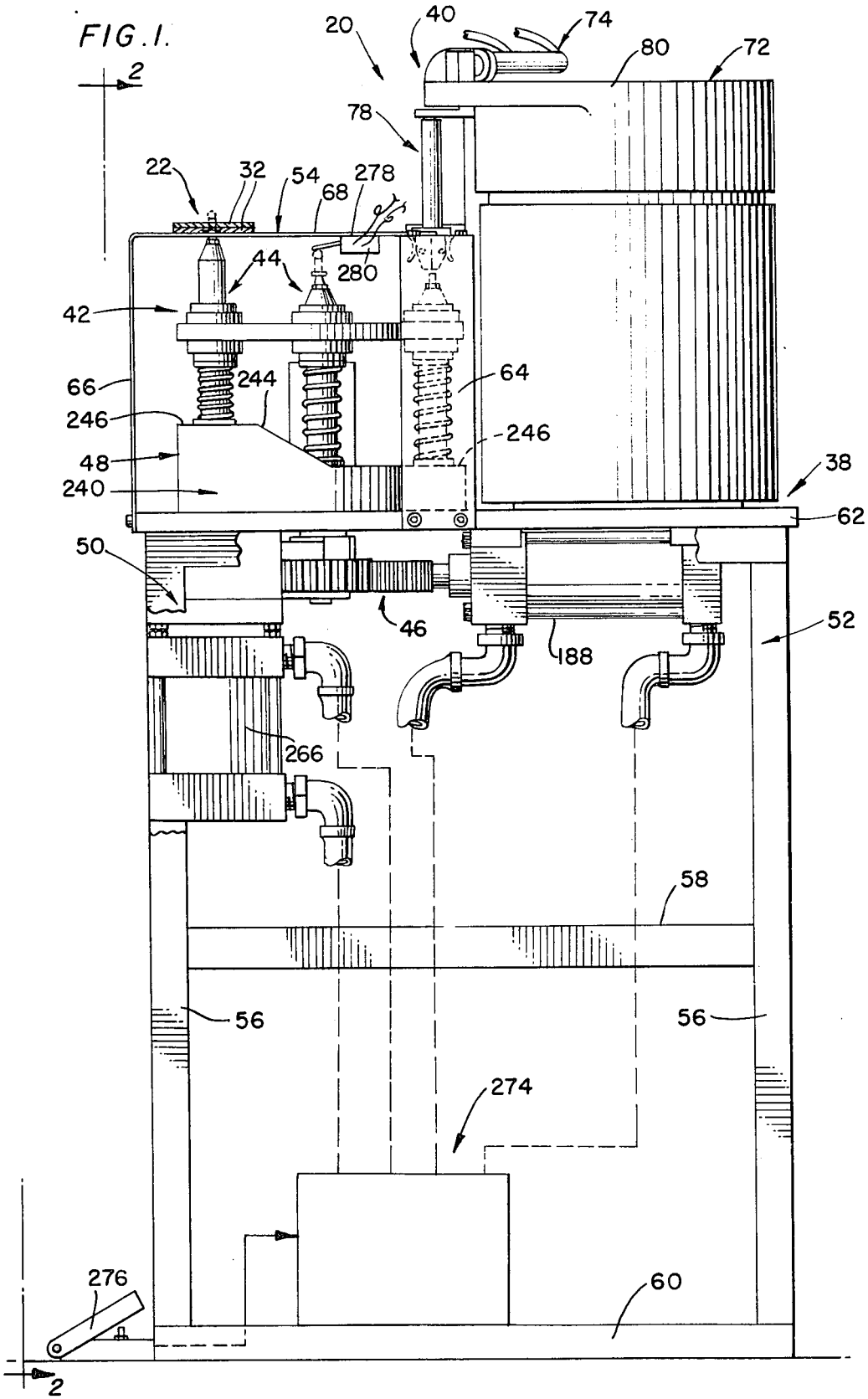
FIG. 1 is a side elevational view of a preferred embodiment of a novel and improved rivet setting apparatus made in accordance with the principles of the present invention.
Figure 4:
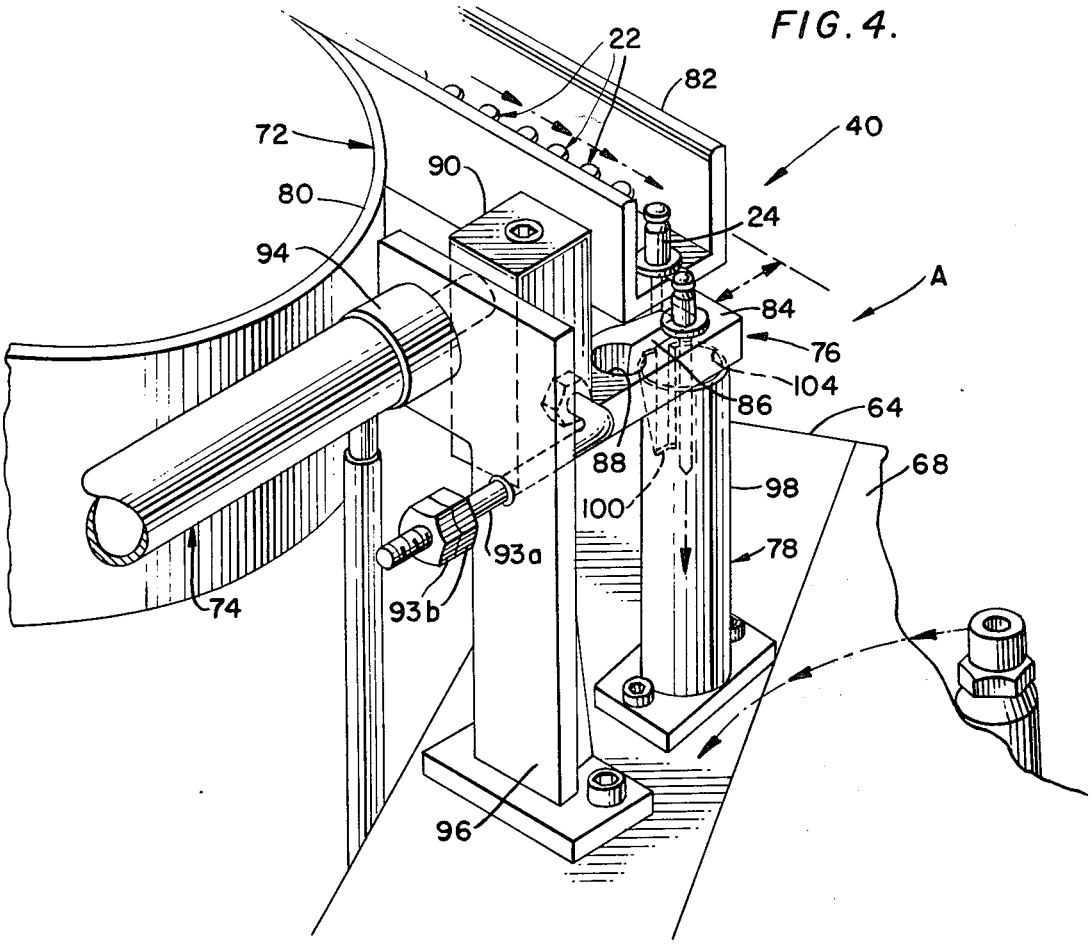
FIG. 4 is an enlarged perspective view illustrating in somewhat greater detail the novel and improved feed assembly means of the rivet setting apparatus.
Figure 5:
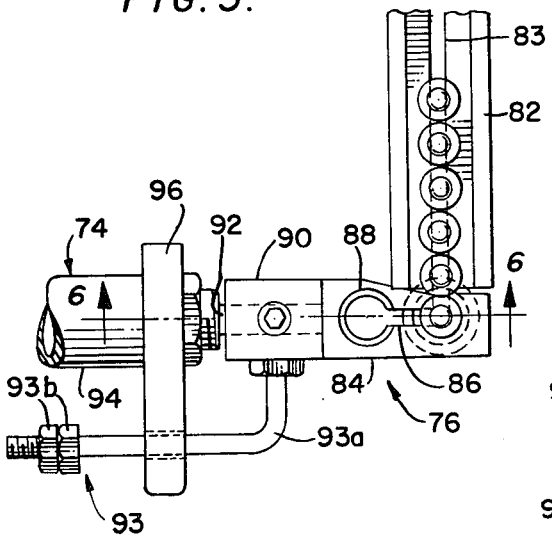
FIG. 5 is a fragmented plan view showing the feed assembly of FIG. 4 in the inoperative position.

Referring now to the figures of the drawings and, in particular, to FIG. 1, there is perhaps best illustrated the novel and improved rivet setting apparatus of the present invention being generally designated by reference numeral 20. Such rivet setting apparatus 20 is particularly adapted for use in the continuous setting of blind rivet type fasteners 22 of the general type depicted in FIG. 12. As therein shown, such type of conventional blind rivet fastener 22 is primarily characterized as including a flanged eyelet or outer rivet section 24 which is conventionally connected to a generally elongated mandrel 26 having an enlarged head portion 28 at one end thereof which engages eyelet portion 24. The mandrel 26 is arranged to project through the eyelet portion 24. In customary usage, eyelet portion 24 and mandrel head 28 are adapted to be suitably inserted within aligned apertures 30 of the workpieces 32. As will be more fully described in the succeeding description of the instant embodiment, to effectuate a riveting action, a protruding mandrel shank 34 is subjected to tensile forces which are sufficient in magnitude to pull such mandrel head 28 with respect to the eyelet portion 24. By this particular action, mandrel head 28 deforms the eyelet portion 24 such that a flange 36 is correspondingly formed which is laterally spaced away from a flange on the eyelet portion 24. During this setting action, a portion of the mandrel shank 34 ruptures and separates from the remainder of the mandrel. As a consequence thereof, the workpieces 32 are locked or riveted together.

As envisioned, the preferred embodiment of the rivet setting apparatus 20 basically comprises support means 38, feed assembly means 40, carriage means 42 including rivet holding assembly means 44, drive means 46, motion producing means 48, and rivet setting means 50.

Particularly referring to FIG. 1 taken in conjunction with FIG. 2, the support means 38 includes a frame structure generally designated by reference numeral 52 and detachably connected thereto a work support means 54 which is adapted to provide, in a manner as presently set forth, an effective support for the workpieces 32 which are desired to be riveted together. In regard to the frame structure 52, it will be seen to provide the foundation for the rivet setting apparatus 20 and basically comprises a plurality of upright support frame members 56 having interconnected to and between them typical horizontal structural support members 58. A generally horizontal base plate member 60 may be connected adjacent the bottom of frame members 56 while spaced vertically therefrom and also connected to upright support members 56 is a table support member 62. Such base plate member 60 and table member 62 may be suitably attached to the upright support members 56 in any well-known manner, such as by welding or the like. A generally U-shaped rigid bracket member 64 is appropriately affixed to the table member 62 and is arranged to cooperate with the work support means 54 as well as the feed assembly means 40. The material of the frame structure 52 may be fabricated from any suitable material, preferably, one which is of a durable type and which can withstand repeated heavy use without damage or fracture.

In connection with the work support means 54, as shown in the illustrated embodiment, it may be comprised of, for example, a generally upright support plate 66 connected to support table 62 and a generally flat work support surface 68 as by bolts 67 or the like. The upright support plate 66 may be suitably detachably mounted at one end to the edge of table support member 62 whereas the work support surface 68 is removably connected to bracket member 64 in any conventional fashion which permits the work support surface 68 to be removable for purposes of facilitating deep riveting applications, such as deep channel work, wherein generally U-shaped objects can be placed directly on a stationary nose-piece at the working station as will be afterwards made more apparent. It is contemplated that such work support surface 68, in the assembled condition, include a generally arcuate slot 70. Slot 70 is arranged adjacent one end of work support surface 68 for enabling respective ones of the work holding assembly means 44 to selectively rise above and fall below the generally horizontal plane formed on the work support surface. It should be pointed out, however, that the portion of the work support surface 68 adjacent the slot 70 is the work location wherein the workpieces 32 are to be placed whenever riveted together, as will be subsequently explained in greater detail.

Furthermore, although not shown in the drawings, work support surface 68 may be provided with a conventional and suitable jig apparatus of the type which would allow an operator to accurately align the workpieces 32 so that the corresponding apertures 30 of the several workpieces can be accurately aligned for a riveting operation. Since, as aforenoted, the work support surface 68 is disposed in a generally horizontal plane, an operator of rivet setting apparatus 20 may conveniently set the workpieces 32 to be riveted on the horizontal support surface 68 and quite easily hold the same there with relatively little effort. This is especially so when compared to the effort normally required with other known blind rivet setting apparatus which often make it extremely difficult for an operator to hold and maintain proper alignment of the workpieces. Clearly, since the workpieces 32 are supported on a convenient working surface, the operator has his hands free to properly align and more easily retain such pieces in proper positions for a particular rivet setting operation. This particular feature provides for several distinct advantages. As earlier indicated, the work support surface 68 enables accurate alignment to be more easily accomplished. This is so especially in situations wherein several workpieces 32 are to be aligned in a particular angular orientation with respect to each other. It is further envisioned as being within the spirit and scope of the present invention that the work support surface 68 may be suitably replaced with other work support surfaces having even larger dimensions so as to appropriately handle workpieces 32 of correspondingly larger dimensions. As is believed evident, the overall production line work of the blind riveting operation is enabled to be speeded up with consequent savings in labor and costs. Consequently, the rivet setting operation may be performed in an extremely versatile, convenient, and economical manner.

Figure 7:
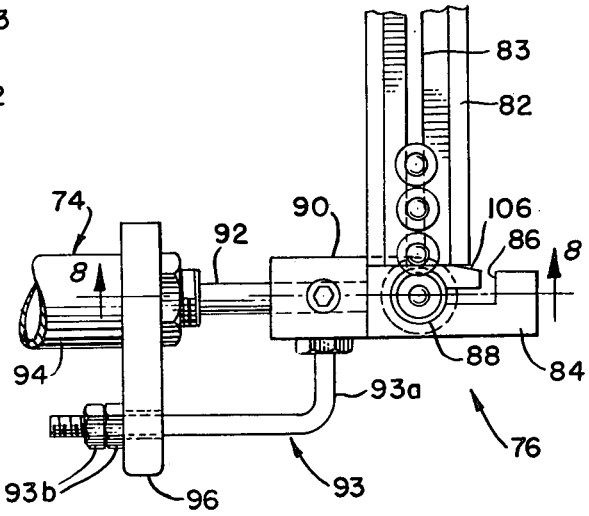
FIG. 7 is a fragmented plan view showing the feed assembly means as shown in FIG. 5 but in an operative position.

With further reference to FIG. 1 taken in combination with FIGS. 2 through 8 the feed assembly means 40 of the embodiment being illustrated essentially comprises feed parts hopper means 72, feed motor means 74, feed control means 76 and guide means 78. The feed hopper means 72 as used in the present invention may be any suitable and conventional type of vibratory parts feed hopper 80. Since the structure and operation of feed hopper 80 does not form an aspect of this invention, a detailed explanation of such construction and operation will be dispensed with. However, to more fully appreciate the operation of the present invention, it should be explaned that feed hopper 80 will selectively feed individual blind rivets 22 down an inclined exit ramp 82 formed with a linear slot 83. Slot 83 is formed so as to enable the eyelets 24 to be supported by the ramp 82 while allowing rivets 22 to advance in a consecutive succession, such as in the manner more clearly shown in FIGS. 3 and 4. As the rivets 22 descend along the ramp slot 83, they cooperate with the rivet feed control means 76 which, in the embodiment being presently described, is defined by a generally elongated finger member 84 having an entrance slot 86 at one end which communicates with a rivet exit opening 88. The elongated finger member 84 is approximately affixed to the feed motor means 74. Specifically, finger member 84 has a coupling portion 90 which is connected to a reciprocating piston rod 92 of rivet feed fluid motor 94. Also attached to coupling portion 90 is a conventional form of stop means 93 which includes a rod **93*a* having nuts 93*b* threadedly attached to one end which abut plate 96 to limit movement of piston rod 92. Such piston rod 92 and fluid motor 94 define the motor means 74. Fluid motor 94 is suitably connected to a bracket plate 96 which is, in turn, appropriately connected to bracket member 64. Upon selective energization of fluid motor 94 the finger member 84 conjointly reciprocates with piston rod 92 between a retracted position and an extended position (FIG. 7). In the extended position stop nuts 93*b* engage bracket 96 to limit the piston rod stroke. Whenever finger control member 84 is in the retracted position (FIGS. 3, 4, and 5), the entrance slot 86 is aligned with the ramp slot 83 to thereby permit the flange portion of eyelet member 24 to slide into the entrance slot. As the foregoing occurs, the mandrel shank 34 enters with the guide means 78**.

Figure 8:
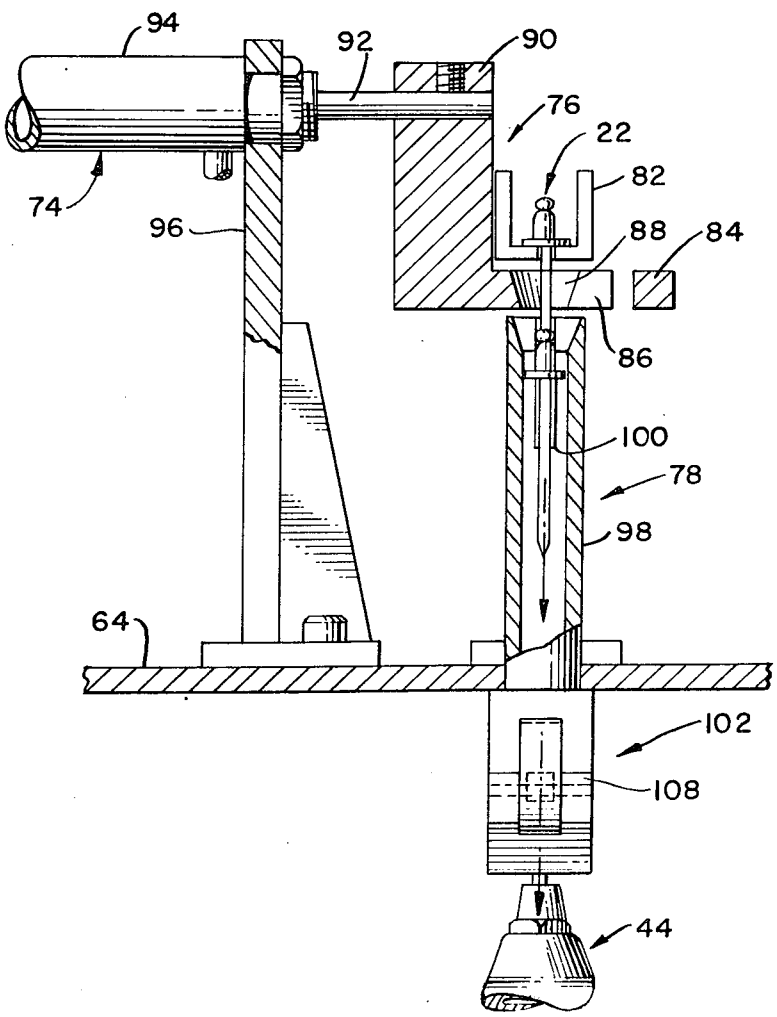
FIG. 8 is a sectional side elevational view taken substantially along section line 8—8 appearing in FIG. 7 looking in the direction of the arrows and illustrating in greater detail the cooperation between the rivet mandrel and the feed assembly means in the operative position.
Figure 6:
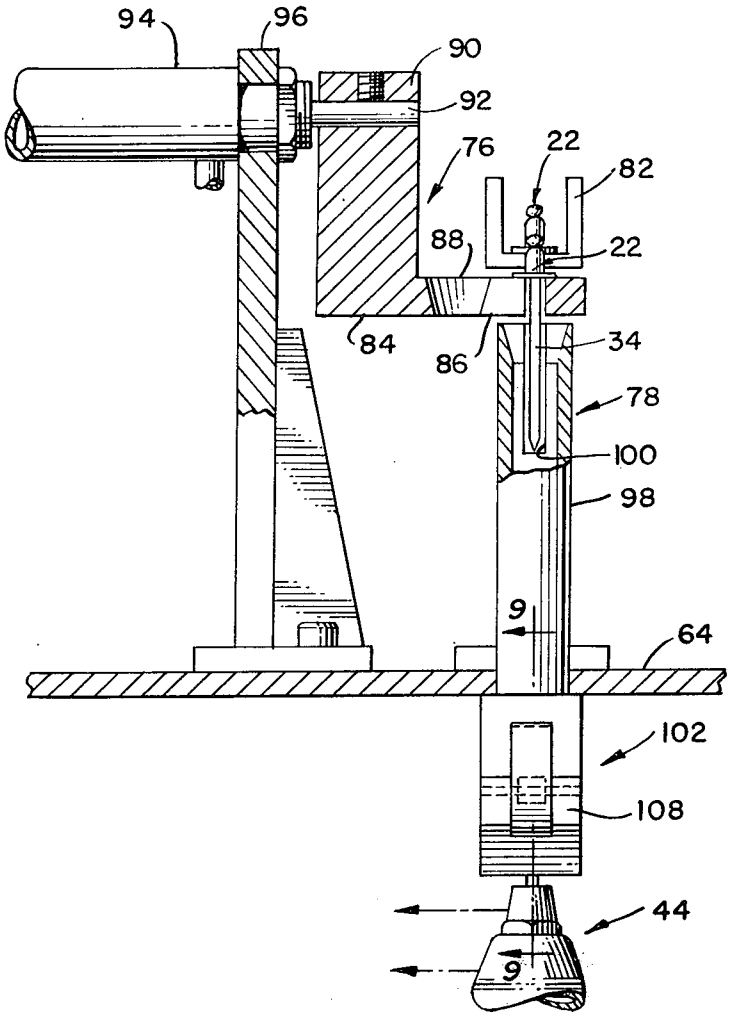
FIG. 6 is a sectional view taken substantially along section line 6—6 appearing in FIG. 5 looking in the direction of the arrows illustrating cooperation between a rivet mandrel with the feed assembly means.

The guide means 78 of the instant embodiment may be defined by a generally elongated tubular guide member 98 having a longitudinal recess 100 formed adjacent the top end thereof and perhaps more particularly depicted in FIGS. 6 and 8 a gate means 102. The guide tube 98 may be appropriately fastened in any suitable manner to the bracket member 64 and extends through an opening formed therein. Guide tube 98 serves to allow the blind rivets 22 to descend therethrough for purposes presently made evident. Such longitudinal recess 100 enables the mandrel shank 34 to enter within the guide tube 98 as such shank leaves slotted exit ramp 82 and enters entrance slot 86. It will be appreciated that actuation of fluid motor 94 will serve to extend piston rod 92. Conjointly movable therewith, to the fully extended position, is the finger control member 84. During this movement, mandrel shank 34 will, likewise, be displaced until such movement thereof is arrested by reason of the shank contacts with the inner wall 104 of guide tube 98. Consequently, continued movement of finger control member 84 results in its relative movement with respect to the blind rivet 22 whereby the rivet 22 is relatively moved towards rivet exit opening 88. Exit opening 88 is appropriately dimensioned to enable the blind rivet 22 to descend therethrough. Accordingly, as piston rod 92 reaches the end of its stroke, the eyelet portion 24 will fall through exit opening 88 and fall into guide tube member 98 until it contacts the gate means 102. Whenever the finger control member 84 is in the extended position, longitudinal edge 106 (FIG. 7) will obstruct further downward movement of another individual rivet 22 disposed in the slotted ramp 82 in the manner clearly depicted in FIG. 7. Retraction of piston rod 92 serves to return the entrance slot 86 to the position wherein it once again is aligned with the slot 83 to receive another rivet 22. As can be appreciated from the foregoing description, the feed assembly means 40 selectively controls the delivery of individual blind rivets 22.

Figure 9:
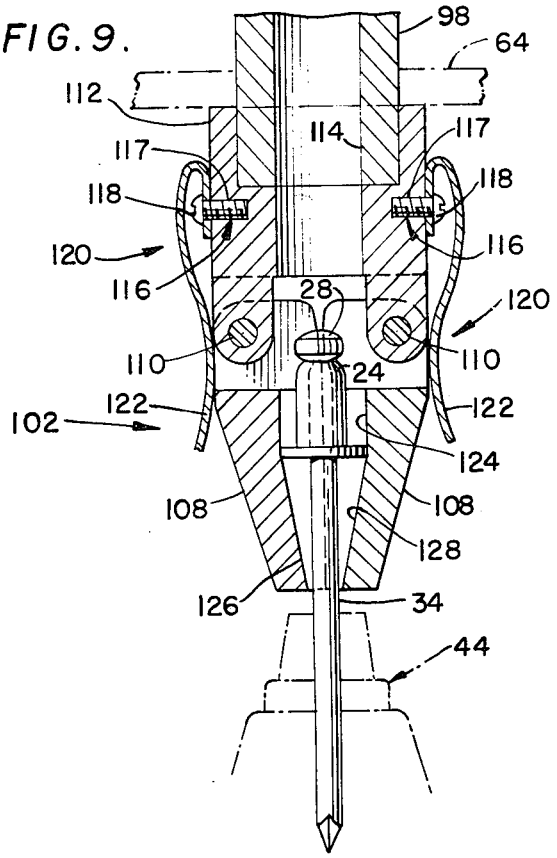
FIG. 9 is an enlarged sectional side elevational view of a novel and improved gate means of the present invention shown insuring alignment of the rivet in a work holder assembly.
Figure 10:
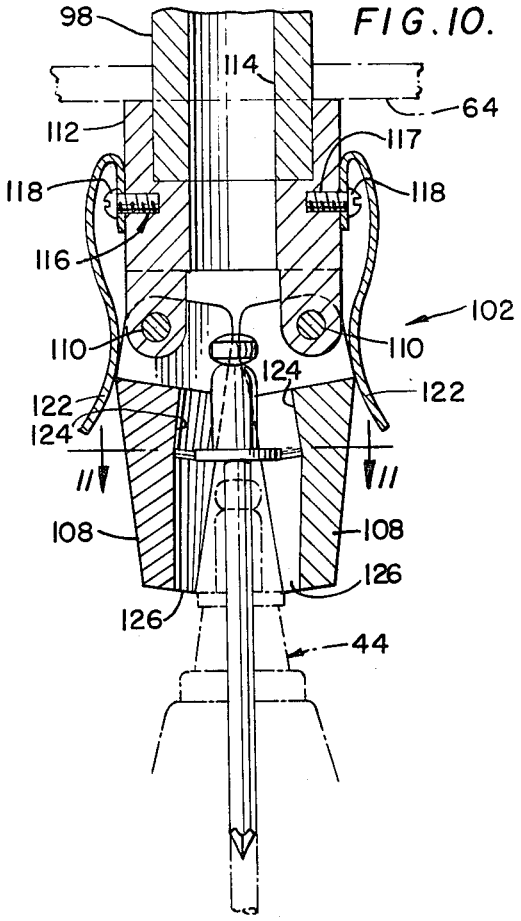
FIG. 10 is a view similar to FIG. 9 but illustrating the rivet as it exits from the gate means of the present invention.
Figure 11:
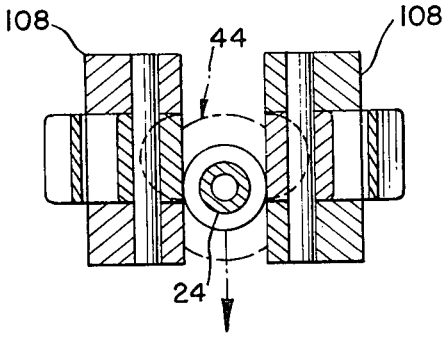
FIG. 11 is a plan sectional view taken substantially along section line 11—11 appearing in FIG. 10 looking in the direction of the arrows and illustrating in somewhat greater detail the cooperation between the rivet and the gate means as the former exits the latter.

As perhaps more particularly shown in FIGS. 9 to 11, the rivet gate means 102 of the present embodiment will serve to properly align the mandrel shank 34 in rivet holder assembly means 44. Rivet gate means 102 may include a pair of hinged rivet gate members 108 which are pivotally attached as at 110 to a support member 112. Support member 112 has a centrally formed bore 114, a pair of securement means 116, which may in the preferred embodiment be comprised of threaded recesses suitably connected to the bracket member 64 and appropriately connected at the end of guide tube 98. Such rivet gate members 108 are normally biased together by respective resilient means 120 such as a leaf spring 122 or the like. One end of each leaf spring 122 is suitably attached to a corresponding recess 117 by threaded member 118. Each of the pivotal gate members 108 has larger and smaller cut-out portions 124 and 126, respectively, formed on its inward surface. The larger cut-out portions 124 are dimensioned to enable the flange of the rivet eyelet portion 24 to pass therethrough, whereas the smaller cut-out portions 126 are formed to define a pilot channel 128 which normally serves to receive the mandrel shank 34. Whenever both of the gate members 108 are urged into contact with each other, such as depicted in FIG. 9, oppositely mating large cut-out portions 124 serve to provide a seat support for the flange of eyelet portion 24 after the latter descends through guide tube 98, whereas the pilot channel 128 serves to receive the mandrel shank 34. It is contemplated by the invention that pilot channel 128 be vertically situated above rivet holding assembly means 44 so that mandrel shank 34 may be received within the rivet holding assembly means. By the foregoing constructional arrangement, the tendency for rivet misalignment as it descends through guide tube 98 to rivet holding assembly means 44 is substantially eliminated by reason of it being guided into a correct position by gate members 108. Accordingly, the likelihood that mandrel shank 34 might not be received in rivet holding assembly means 44 is substantially reduced if not eliminated. Of course, each of the particular rivet holding assembly means 44 receives a blind rivet 22.

The biased rivet gate members 108, however, do pivotally swing to an outward position, as indicated in FIGS. 10 and 11, whenever the carriage means 42 is indexed in a manner which will be presently described. During this indexing, the rivet 22 which is received by and conjointly movable with rivet holding assembly means 44 and, consequently, will overcome the bias force provided by leaf springs 122. As it does so, the mandrel shank 34 will further fall within the rivet holding means 44 for purposes afterwards made apparent.

Figure 13:
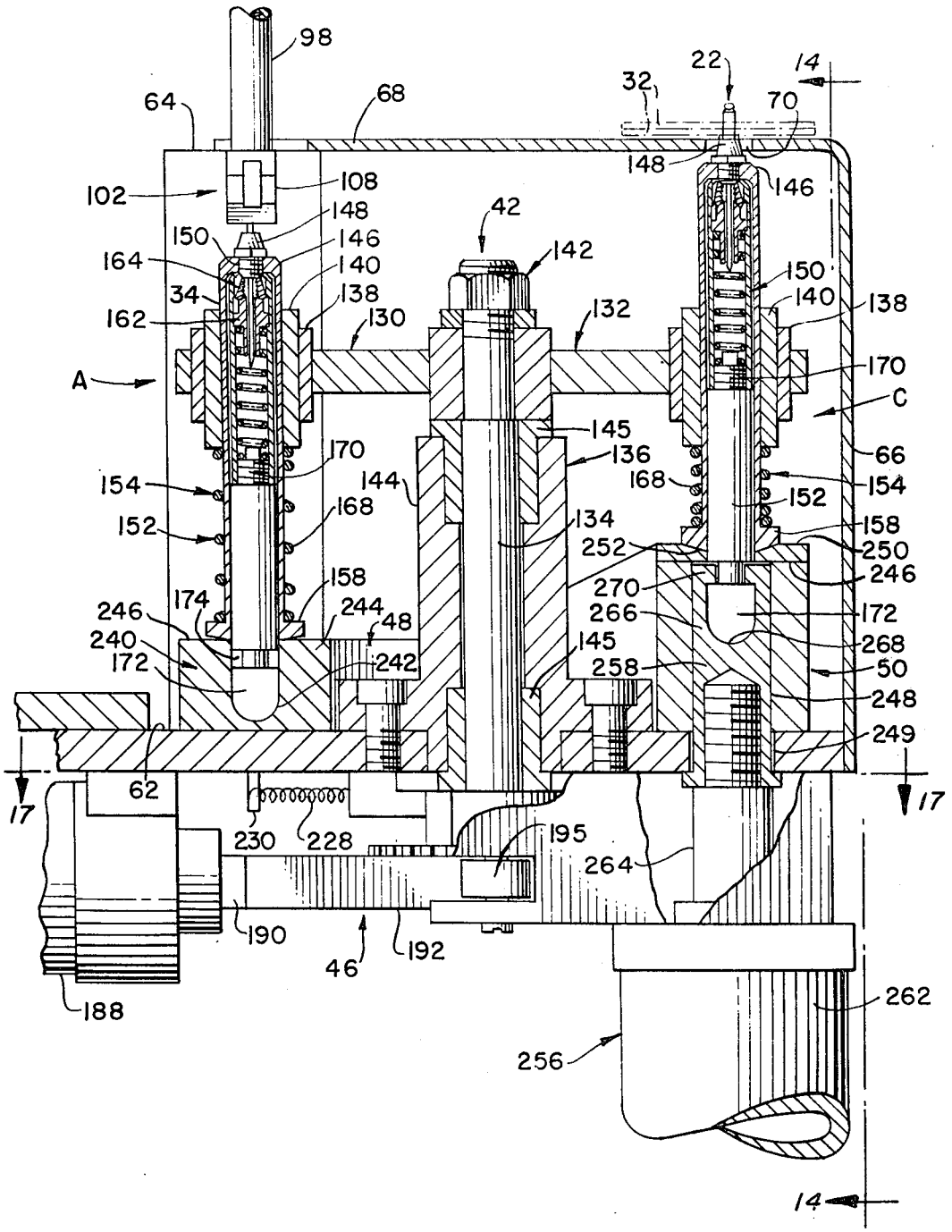
FIG. 13 is a side elevational view taken substantially along section line 13—13 appearing in FIG. 2 looking in the direction of the arrows and illustrating in some detail other structure of the rivet setting apparatus.
Figure 14:
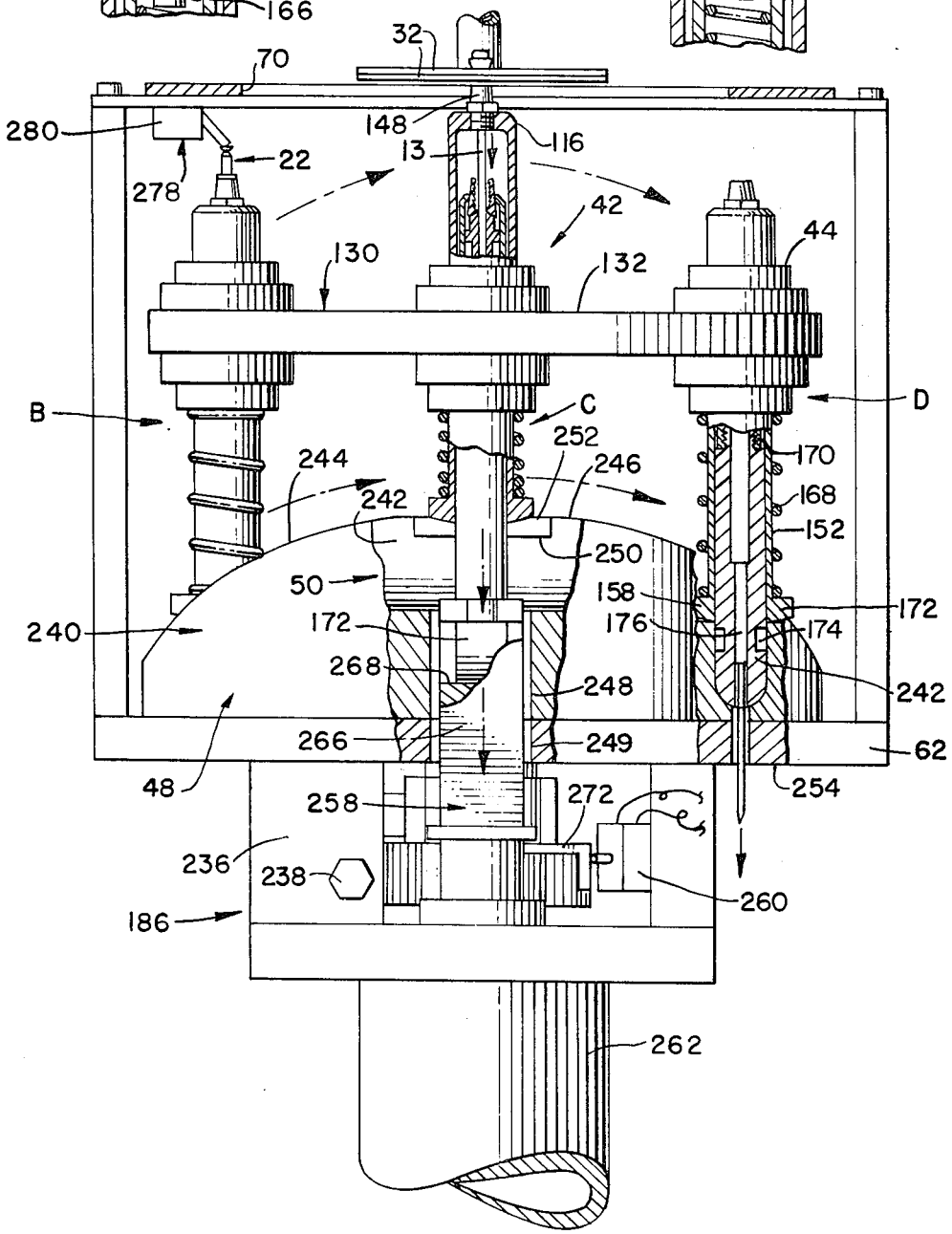
FIG. 14 is an end elevational view taken along line 14—14 appearing in FIG. 13 looking in the direction of the arrows and illustrating even more detail of the rivet setting apparatus.

The carriage means 42 of the present embodiment is perhaps best illustrated in FIG. 1 taken along with FIGS. 2, 13, and 14. As therein depicted, carriage means 42 basically includes rivet holding assembly means 44 and a turret means 130, which has associated therewith a plurality of holding means 44. The turret means 130 may include a turret plate 132, drive shaft 134, and shaft housing means 136. The turret plate 132 is a generally flat circular member having a plurality of circumferentially spaced boss openings 138 which are, preferably, spaced by about 90° from each other. Although, of course, the instant embodiment discloses four such boss members 138 others may also be provided for as would be required for a particular situation. Standard bushings 140 are conventionally secured within corresponding boss openings 138 for purposes of allowing each of the respective rivet holding assembly means 44 to be vertically reciprocated relative thereto. The particular significance of allowing such vertical movement will be afterwards more fully described in the succeeding description of the present invention. The drive shaft 134 may be attached at one end thereof to the turret plate 132 by a bolt means 142. Shaft housing means 136 includes an elongated housing member 144 having oppositely spaced journals 145 for permitting rotation of shaft 134. Shaft housing 144 is attached to the table 62 through threaded bolts or the like. The opposite end of the shaft 134 is, in a manner more fully described, connected to drive means 46. The turret plate 132, as will be presently described, is successively indexed in a step-by-step fashion from at least a loading station A, thereafter towards a sensing station B, working or firing station C, discharge station D, and back again to the loading station A, for a complete cycle of operation.

In a normal rivet setting operation, respective ones of the rivet holding assembly means 44 will be fed a blind rivet at the loading station A. As can be fully appreciated, whenever this occurs, the turret plate 132 is in a rest position. Simultaneously with this rivet feeding operation, the rivet setting means 50 is operable to actuate a corresponding rivet holding assembly means 44 to set the rivet 22. As illustrated in the drawing, the loading and working stations A and C, respectively, are diametrically opposite to each other. On the other hand, the sensing and discharge stations B and D, respectively, are similarly diametrically opposed from each other. The incremental indexing of respective ones of the rivet holding assembly means 44 between the aforementioned stations is accomplished by reason of the drive means 46 which positively indexes advancement of turret plate 132. As will be more fully described, a typical rivet holding assembly means 44 will be successively and incrementally advanced or indexed from the loading station A to sensing station B, to working or firing station C, to discharge station D, and returned again to the loading station A, thereby completing one cycle of operation.

In connection with the rivet holding assembly means 44, reference is made to FIGS. 13 to 16. As shown, each rivet holding means 44 is comprised to outer shell member 146, a nose-piece attachment 148, standard chuck assembly 150, cam follower member 152, and biasing means 154.

With respect to the shell member 146, it is adapted to be slidably engaged within the bushing 140 for selective vertical reciprocation. Threadedly secured to an opening 156 in the top of shell member 146 is the nose-piece attachment 148 which is a conventional type normally used in association with chuck assembly 150 for blind rivets. Typically, nose-piece attachment 148 as more clearly shown in FIGS. 1, 15, and 16, centrally receives the mandrel shank 34 therethrough. It should be pointed out that nose-piece 148 may be suitably replaced by other sizes of nose-pieces in conventional fashion so as to enable mandrels of varying diameters to be selectively gripped by the chuck assembly 150 in a well-known manner. A radial flange 158 is formed adjacent the bottom of shell member 146 for association with biasing means 154. The significance of this particular arrangement will be set forth presently.

Figure 15:
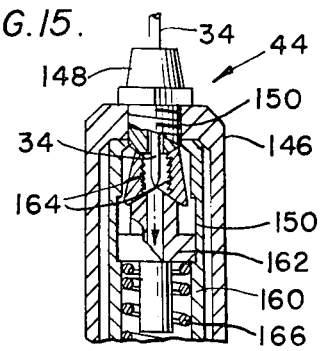
FIG. 15 is an enlarged fragmented side sectional view illustrating the open position of the chuck assembly means of the present invention.
Figure 16:
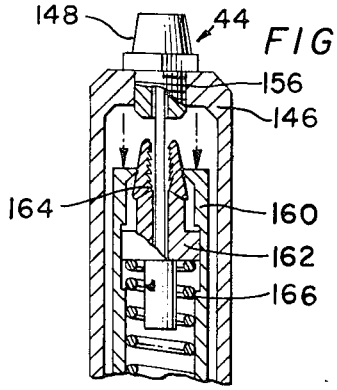
FIG. 16 is a view similar to FIG. 15 illustrating the chuck assembly means of the present invention in a closed position.

The chuck assembly 150 is of a conventional kind for association with blind rivets 22 and includes a tubular body portion 160, a jaw pusher or collet portion 162, a pair of cooperating jaws 164, and coil spring 166. Tubular portion 160 is axially slidable within shell member 146. The jaw pusher or collet portion 162 and pair of resilient mandrel gripper jaws 164, are, in turn, normally, coaxially disposed within the body portion 160 so as to be capable of relative axial movement thereto. Such jaws 164 are tapered, as shown in FIGS. 15 and 16, and are adapted to normally cooperate with nose-piece member 148. Small coil spring 166 is interposed between cam follower member 152 and the collet portion 162 and normally serves to bias collet portion 162 and thereby jaws 164 outwardly such that the jaws protrude from the tubular portion 160 for engagement with nose-piece 148. In addition, the collet member 162 has a bore formed therethrough which is aligned with the opening of the nose-piece 148 for receiving mandrel shanks 34. Whenever the jaws 164 are urged into engagement with nose-piece 148, the jaws, as is conventional, will be spread apart to assume an open condition which allows for receipt of mandrel shank 34. It is contemplated by the present invention that gripper jaws 164 will normally be in the open position until the blind rivet is to be set at the working station C. As will be more fully described, whenever a setting operation is to be performed, the gripper jaws 164 will be actuated such that they close about and tightly grasp mandrel shank 34 for enabling the setting operation to be performed. To so actuate jaws 164, they must, however, be withdrawn from contact with the nose-piece member 148. As will also be explained, such withdrawal is accomplished by overcoming the bias provided by biasing means 154.

In regard to the biasing means 154 of the present embodiment, it is seen to include a coil spring 168 which is operatively interposed between shell flange 158 and bushing 140. Coil spring 168 basically serves a dual purpose in that it not only urges jaws 164 into intimate contact between nose-piece 148 so as to open the gripper jaws 164 but also insures an intimate contact between cam follower 152 and motion producing means 48.

With respect to the cam follower member 152 as clearly illustrated in FIGS. 13 and 14, it is generally elongated and has a threaded section 170 at one end thereof and opposite thereto a generally rounded cam surface member 172. The threaded section 170 cooperates with a correspondingly threaded section formed by the tubular body portion 160. Cam surface 172 is adapted to be urged into non-yielding contact with the motion producing means 48 by virtue of coil spring 168. A retaining notch 174 is also formed in cam member 152 for purposes presently discussed. Formed through the axial extent of the cam follower member 152 is a bore 176. Such bore 176 is adapted to receive the ruptured or spent mandrel shanks 34 as they descend. In this manner, the subsequent discharging of mandrel shanks 34 after the rivet setting operation is facilitated.

Figure 17:
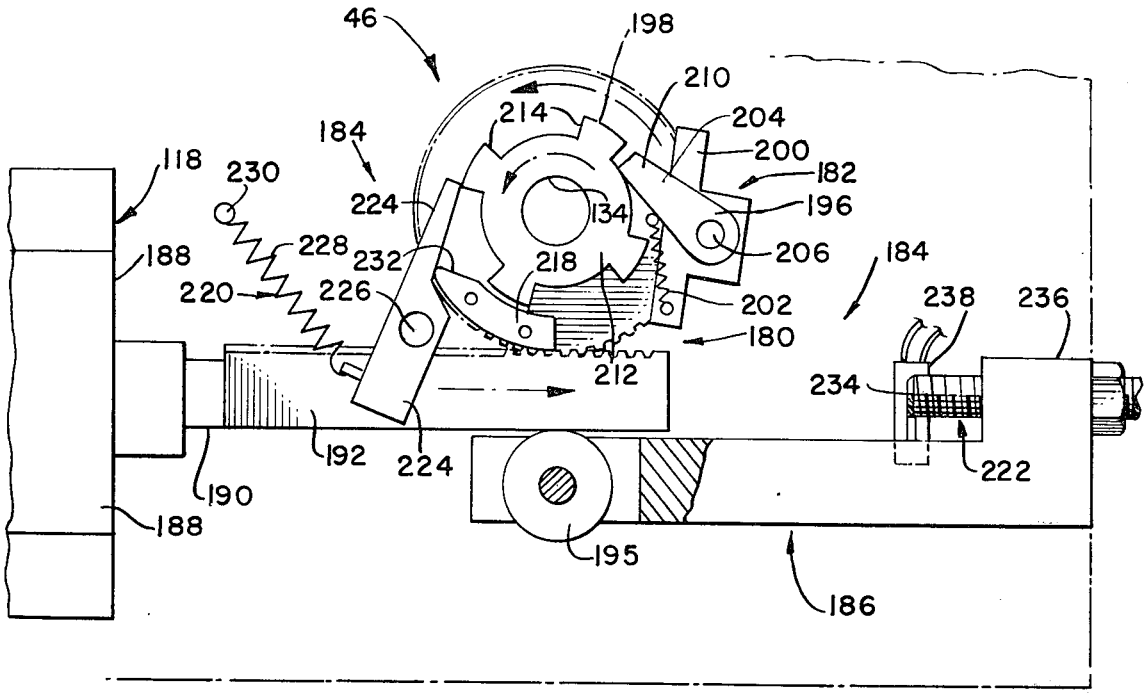
FIG. 17 is a plan elevational view taken substantially along section line 17—17 appearing in FIG. 13 looking in the direction of the arrows and illustrating a novel and improved drive means of the present invention.
Figure 18:
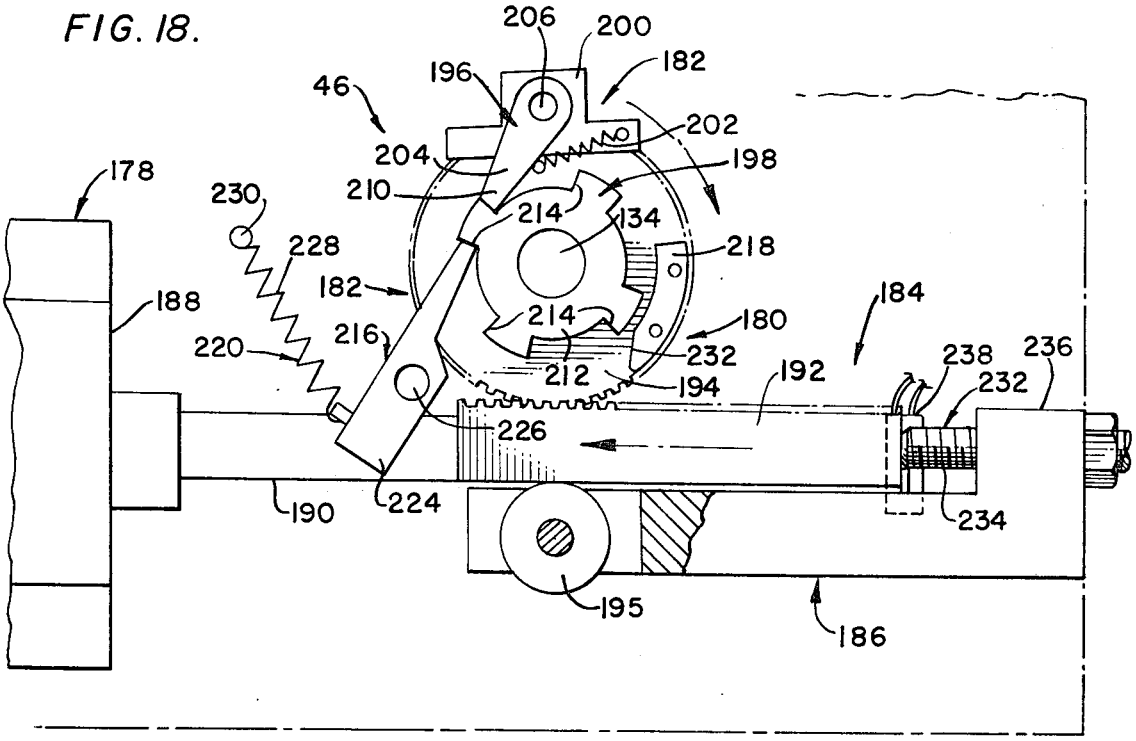
FIG. 18 is a view similar to FIG. 17 but depicting the components of the drive means in a different operative position.

With respect to the drive means 46, it is more clearly shown in FIG. 1 taken in combination with FIGS. 13, 17, and 18. As depicted, drive means 46 is seen to basically include drive motor means 178, rack and pinion means 180, indexing means 182, double stop means 184, and support member 186. Drive motor means 178 may be defined by any suitable type of fluid motor 188 or the like, which is selectively energized to cause longitudinal reciprocation of piston rod 190. The fluid motor 188 is connected in any conventional fashion to the bottom of horizontal table support member 62. In connection with the rack and pinion means 180, it may include a conventional rack member 192 having a plurality of teeth and which is suitably affixed to one end of piston rod 190 so as to be conjointly movable therewith in a back and forth direction. Rack 192 is in meshing engagement with a conventional pinion member 194 rotatable with respect to the lower end of drive shaft 134. Although, of course, the present embodiment has disclosed a rack and pinion means 180 for purposes of converting the reciprocatory motion of the piston rod 190 to oscillatory or rotary movement of drive shaft 134, it is well within the spirit and scope of the present invention that other known and suitable means may be effectively used to operate in the same manner. Rack and pinion means 180 may additionally include a roller 195 which is designed to contact the underneath surface of the rack 192 for not only facilitating longitudinal reciprocation of the rack 192 but also for ensuring a more firm engagement between the rack 192 and pinion 194. Such roller 195 is suitably rotatably mounted on a support member 186 appropriately fastened to table support member 62.

The indexing means 182 essentially includes a drive pawl means 196 and ratchet wheel means 198. The drive pawl means 196 comprises a bracket member 200, a spring member 202, and a drive pawl member 204. The bracket member 200 is fixedly secured to pinion member 194 so as to be conjointly rotatable therewith. Pawl member 204 is pivotably mounted on bracket member 200 by pivot shaft 206. Spring member 202 is interconnected, in suitable fashion, to and between bracket member 204 and pawl member 200, respectively. Such spring member 202 serves to normally urge the front end 210 of pawl member 204, counterclockwise as viewed in FIG. 18 into contact with the ratchet wheel means 198. Ratchet wheel means 198 may basically include a typical form of ratchet wheel member 212 having a plurality of circumferentially spaced and radially extending teeth 214. Such ratchet wheel member 212 is firmly secured, in conventional fashion, to the bottom portion of the drive shaft 134 by any conventional device. Since the present invention envisions that there are to be four distinct operative steps, ratchet wheel 212 is provided with four ratchet teeth 214. By virtue of this construction, whenever the drive fluid motor 188 is fluidally energized so as to extend piston rod 190 and rack 192 from the retracted position, shown in FIG. 17, to the extended position, indicated in FIG. 18, the pinion member 194 will, through its meshing engaging with the rack 192, be driven in a counterclockwise direction as viewed in the drawing. Simultaneously, the front end 210 of drive pawl 204 will contact one side of tooth 214 to thereby correspondingly drive ratchet wheel 212 and the drive shaft 134 connected thereto. Consequently, of course, the carriage means 42 is suitably enabled to be advanced one incremental position.

The double stop means 184 may include a stop pawl means 216, knocker member 218, biasing means 220 and a second stop means 222. The stop pawl means 216 essentially comprises a stop pawl member 224 which is conventionally pivotably mounted on the underside of table support member 62 such as at 226. Such stop pawl member 224 has a relatively narrow and tapered forward end which is adapted to come within the path of circumferential movement of the radially extending ratchet teeth 214. The biasing means 220 includes a conventional spring member 228 which is interconnected to and between a post member 230 which is suspended from underneath table support member 62 and one end of the stop pawl 224. Spring member 228 serves to bias the stop latch pawl 224 in a clockwise direction. In this manner, whenever the stop pawl 224 is urged into the path of movement of the ratchet wheel 212, it will contact the opposite surfaces of respective ones of the ratchet teeth 214 which have been driven by drive pawl 204 so as to positively arrest further rotation of the ratchet wheel. The normal position for the stop pawl 224 is out of engagement with the path of circumferential movement of ratchet teeth 214. To properly maintain the stop pawl 224 out of engagement with ratchet wheel member 212, the knocker member 218 is provided. Such knocker member 218 is generally arcuate in configuration having one end 232 thereof which is adapted to engage the forward portion of stop pawl 224 so as to urge it out of contact with teeth 214. Knocker member 232 is connected to the pinion 194 so as to be rotatable in unison therewith. During driving movement of the pinion member 194 by virtue of rack 92 being longitudinally advanced rightwardly, as viewed in FIG. 17, knocker member 218 will rotate along with the pinion member. As is believed evident, knocker member 218 will no longer engage the forward portion of stop pawl spring 224. Consequently, the stop pawl 224 is urged, under the influence of spring member 228, into engagement with the surface of the ratchet wheel 212. Whenever the stop pawl 224 is in this particular position, it will eventually contact the opposite surface of the ratchet tooth 214 for positively preventing further rotation of the ratchet wheel 212. In addition to the positive stop provided by stop pawl 224, the present invention also may utilize the second stop means 222. The stop means 222 is basically defined by an adjustable screw member 234. Screw member 234 extends through support portion 236 of support means 186 and has its forward end adapted to engage the forward end of the rack 192 at the end of the latter's drive stroke. Although second stop means 222 has been disclosed, it is, of course, envisioned that the positive stopping action may be provided exclusively by the stop pawl 224, as previously indicated. In a normal rest position of the rivet setting apparatus 20, it is envisioned that the rack 192 will be in its extended position as shown in FIG. 18. To effect the positive driving advancement of the pinion member 194, the fluid motor 188 is initially retracted to the position shown in FIG. 17 and then advanced in the opposite direction to the position indicated in FIG. 18. Such operation enables the drive pawl 204 to contact a corresponding ratchet tooth 214 so as to correspondingly drive the ratchet wheel 212.

Also as viewed in FIGS. 17 and 18, a conventional type of microswitch 238 is appropriately situated so it will be engaged by the forward portion of the rack 192, as the latter reaches the termination of its stroke. Whenever microswitch 238 is actuated, it will, in a manner to be more fully explained, enable actuation of the feed means 40 and rivet setting means 50.

Referring now to the motion producing means 48 envisioned by the principles of the present invention, it essentially includes a stationary cam means 240 which is appropriately connected through conventional means to the stationary table support member 62, as perhaps best viewed in FIG. 1 together with FIGS. 2, 13, and 14. A generally continuous slot 242 is formed therein and is adapted to snugly receive cam surface member 172. Continuous slot 242 is in this particular embodiment in the form of a circle for facilitating the rotary movement of carriage means 42. The slot 242 functions to define the path through which each of the respective rivet holder assembly means 44 of carriage means 42 may be successively and incrementally advanced from the loading station A to the sensing station B, to the working station C, to the discharge station D and back again to the loading station A for completing one cycle of operation. The cam means 240 also defines cam surface 244 which is arranged to slidably receive thereon shell flange 158. The present invention envisions cam means 240 having a specific rise and fall so as to provide for the predetermined generally vertical relative movement of the rivet holding assembly means 44 with respect to the stationary work support surface 68. By so arrangeing the rise and fall, the rivet 22 held in holding assembly means 44 will be able to provide for the necessary action to actuate the chuck assemblies 150 so that they receive and appropriately grasp the mandrel shanks 34. At one point it elevates respective ones of rivet hold means 44 for enabling subsequent vertical displacement thereof to set the rivet 22 in the workpieces 32 to be riveted at the working station C. By having a continuous rise and fall to the cam surface 244 less stress and strain on the various components forming apparatus 20 will be encountered. Accordingly, a much smoother and continuous rivet setting action results. It will be understood that the rise and fall may be adjusted to provide for such smooth movement. Of course, the rise occurs as each of the rivet holding assembly means 44 advances from the holding station A to the working station C, whereas the fall occurs during the return movement of holding means 44 to the loading station A. Consequently, shell member 146 will correspondingly rise with respect to the turret place 132 during the cam rise and descend relative thereto as shell member descends on cam surface 244. It is further contemplated by the present invention that the cam surface 244 be formed with generally flat surfaces 246 at the loading station A and work station C. With relatively flat cam surfaces 246 at the loading and working stations A and C, respectively, there is assured more proper alignment of rivet holding means 44 with respect to the feed assembly means 40 and setting means 50. As is believed readily apparent from the foregoing description, by having the rise located adjacent the working station C, the eyelet portions 24 of blind rivets 22 will be presented above the work support surface 68 for thereby easily enabling operators to insert the eyelet portion 24 with the aligned apertures 30 of workpieces 32 or the like.

As is best shown in FIGS. 13 and 14, the stationary cam means 240 has a generally vertically extending guide passage 248 extending therethrough which is aligned with opening 249 formed in table support member 62 and serves to cooperate with the rivet setting means 50. A wear plate member 250 has a generally depressed surface area 252 and is appropriately secured to the top surface of the cam means 240 by conventional means. Wear plate 250 basically serves the purpose of preventing excessive wear between the holder means 44 and cam means 240 at the working station C, by reason of the forces generated during a setting operation. Depressed surface 252 defines a seat which is generally complementary to the configuration of shell flange 158. By the foregoing, whenever a respective one of rivet holding assembly means 44 is indexed to the working station C, it will nest within seat 252 to form a more secure engagement with the cam means 240. In this particular manner, whenever the rivet holding assembly means 44 is acted upon by the rivet setting means 50, the former will be able to more adequately withstand the forces generated thereon and, in addition, this particular arrangement tends to reduce stress and strain on the respective component parts during the setting operation.

As also perhaps best viewed in FIG. 14, the embodiment illustrated shows a discharge opening 254 formed in cam means 240 and table support member 62 at the discharge station D. Such opening 254 communicates with circular slot 242. Accordingly, whenever each of the rivet holding assembly means 44 has been advanced to the discharge station D, a spent mandrel shank 34 which has been sheared by reason of the setting operation is enabled to descend through bore 176 formed in cam follower 152 and discharge opening 254 to a suitable receptacle 256 or the like (FIG. 2) for receipt of the same. Although discharge opening 254 has been described at the discharge station it is, of course, within the theory and practice of the instant invention that such discharge opening may be conveniently provided for at the loading station A or even the sensing station B without departing from the spirit and scope thereof. It should also be pointed out, however, that the size of the discharge opening 254 should not be of such a dimension as to interfere with cam surface member 172 as the rivet holding assembly means 44 is intermittently advanced. The size, however, should be sufficient to permit the passage therethrough of the mandrel shanks 34.

Specifically referring to FIG. 2 taken together with FIGS. 13 and 14, the rivet setting means 50 of the instant embodiment is more clearly depicted. Such rivet setting means 50 includes fluid motor means 256, yoke means 258, and a conventional one-way type of microswitch 260. Fluid motor means 256, as with the others previously described, is of a conventional type which comprises a fluid motor 262 having a piston rod 264 extending therefrom for reciprocation in a generally vertical direction. In addition, fluid motor 262 is appropriately attached to support means 186 so that the piston rod 264 is aligned with guide passage 248 and guide opening 249 for enabling reciprocation of yoke means 258. Yoke means 258 includes a yoke member 266 which is also of such a configuration and size to permit its slidable movement in guide passage 248 and guide opening 249. The yoke member 266 is generally elongated and is internally threaded for securement to the piston rod 264 so as to be conjointly movable therewith. At the opposite end yoke member 266 there is an opening 268 and a pair of arms 270 which are adapted to cooperate with the cam follower member 152. Opening 268 has a configuration which is similar to that of cam surface 172 and cooperates with the cam follower member 152 whenever the later is at working station C as shown in FIG. 14. Towards this end, piston rod 264 is vertically raised so as to enable the opening 268 to cooperate with the configuration of circular slot 242. Since, as previously observed, the cam means 240 is provided with a flat surface 246, the work cam surface member 172 is capable of a relatively easy entrance and exit from yoke opening 268. The yoke arms 270 are adapted to engage the retaining notch 174 formed on cam follower member 152. Consequently, this arrangement enables the yoke member 266 to firmly engage the cam follower member 152. Of course, the present embodiment envisions that other suitable forms of connection between the fluid motor 262 and the cam follower 152 may be employed so long as they are consistent with the spirit and scope of the present invention.

As best viewed in FIGS. 2 and 14, a generally L-shaped actuating finger is attached to piston rod 264 for movement therewith and is arranged to cooperate with the microswitch 260. One-way microswitch 260 is suitably situated on the support means 186 in such a position as to be adjacent the piston rod 264 such that whenever the finger 272 moves upwardly, the microswitch will appropriately enable actuation of the fluid motor 188 in a manner to be presently described.

A conventional and suitable type of commercially available fluid control system 274 is provided for operating the foregoing described fluid motors 94, 188, and 262. This type of control system 274 may be of the type generally referred to as an air logic system. Since the construction, function, and normal operational arrangement of such a system is generally well-known in the art and does not form an aspect of this invention, a detailed description thereof is not believed necessary for understanding the present invention. The control system 274 includes a foot pedal 276 which, whenever actuated by an operator, will serve to actuate the fluid motor 262 of drive means 46. It will be understood, of course, that both the microswitches 238 and 260 are appropriately electrically connected to the control system in a conventional manner so as to enable the selective energization of the various fluid motors in a manner to be subsequently described.

Referring to FIGS. 1 and 14 and as noted earlier, the present invention also contemplates sensing station B. This particular station is located intermediate the loading station A and working station C. Essentially, the sensing station B includes an appropriate sensing means 278 which could comprise a microswitch 280 and be supported to, for example, the bracket 64. The microswitch 280 would be suitably electrically operatively connected to the control system 274 in an appropriate fashion, and it is adapted to come into the path of movement of the rivet head assembly means 44. In its normal position, microswitch 280 is arranged so that it will contact a rivet 22 extending upwardly from the rivet assembly means 44 as the latter is successively and incrementally advanced to the sensing station B. Should, however, a rivet 22 not be contacted or sensed by such microswitch 280, the latter will generate a signal which may be used to indicate that a particular rivet holding assembly means 44 does not have a rivet and arrest motion of the carriage means 42. Accordingly, the operator would be aware that something perhaps is malfunctioning with the feed assembly means 40. Consequently, a safer operation is provided. While this particular embodiment has been described with a sensing means 278, it is to be, of course, understood that the scope of the present invention need not include sensing means 278.

Having thus described the aforenoted constructional arrangement of a preferred embodiment of the rivet setting apparatus 20 of the present invention, the operation thereof will be subsequently set forth. To perhaps best understand the sequence of operations, initial reference will be made to one of the rivet holding assembly means 44 which is at loading station A and in the rest position, since turret plate 132 is at rest. To commence operation, an operator will, of course, depress foot pedal 276 which serves to actuate control system 274 in a known fashion for fluidically energizing fluid motor 94. As earlier pointed out, respective ones of the rivets 22 slide down slot 83 in exit ramp 82 and enter the aligned entrance slot 86 formed in control finger 84. Since guide tube 98 is provided with a recess 100, the mandrel shank 34 is able to be aligned with the guide tube for subsequent descent to the gate means 102. Upon the energization, the piston rod 92 is extended. As a result the rivet 22 initially moves until its shank 34 engages inner wall 104, FIG. 4, continued advancement of piston rod 92, however, enables rivet 22 to advance relatively along slot 86 until eyelet portion 24 falls through rivet exit opening 88. The rivet will descend through guide tube 98 until stopped by gate means 102. As mentioned above, rivet gate members 108 of gate means 102 are normally urged to the closed position, by reason of leaf springs 122. In this particular position, the larger cut-out portions 124 provide a seat for supporting eyelet portion 24. The pilot channel 128 serves to properly align the mandrel shank 34 with an opening in nose-piece 148. Consequently, the rivet 22 is suitably received within one of the rivet holding assembly means 44 for a subsequent setting operation, since such holding means is normally at a position below gate means 102 whenever at rest.

Figure 12:
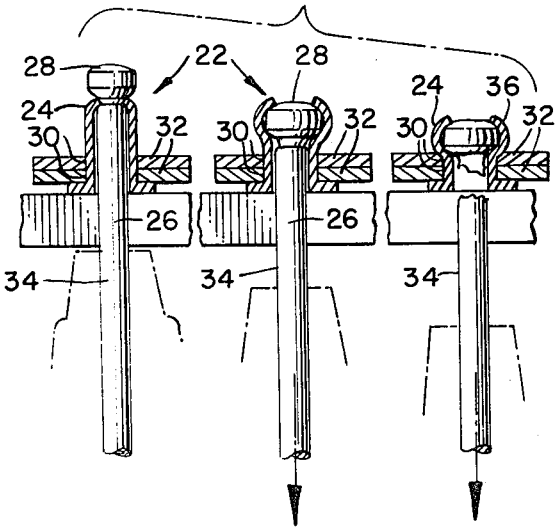
FIG. 12 illustrates a sequence of steps performed at the working station as the blind rivet undergoes a typical rivet setting operation.

Simultaneous with this operation fluid motor 262 is selectively fluidically energized to retract its piston rod 264. It should be pointed out that at working station C, holding means 44 is received within the yoke member 266. As this occurs, yoke member 266, which is affixed to piston rod 264, will, likewise, move downwardly. The yoke arms 270 which are firmly engaged in retaining notch 174 of cam follower 152 will force the chuck assembly 150 downwardly within shell member 146 as indicated in FIG. 14. As clearly depicted, mandrel gripper jaws 164 are no longer in contact with nose-piece 148. As a consequence thereof, they are able to tightly grasp the mandrel shank 34. Of course, prior to the foot pedal 276 actuation, an operator very conveniently and easily aligns the various apertures 30 of workpieces 32 on work support surface 68 adjacent arcuate slot 70. As earlier indicated, by virtue of the cam rise of cam surface 244, a rivet holding assembly means 44 carrying the rivet 22 has risen above the work support surface by a distance which permits an operator of apparatus 20 to conveniently insert the protruding eyelet portion 24 of rivet 22 within the apertures 30 of workpieces 32, such as indicated in FIG. 12. Since the mandrel shank 34 is tightly gripped, the retraction stroke of piston rod 264 is arranged such that it will travel for at least a distance which is predetermined to be sufficient to rupture a segment of mandrel shank 34. The predetermined distance necessary to effect the shearing action is, of course, determined by well-known techniques in this particular field. Therefore, a detailed description as to the specific parameters used will not be discussed. With continued reference to FIG. 12 during this setting operation, head portion 28 will deform the top segment of eyelet portion 24 to the point that a second flange 36 is formed which tightly locks the workpieces 32 together. Thus, a rivet setting operation for one rivet 22 at the working station C is completed. Thereafter, fluid motor 262 acts to return piston rod 264 upwardly to the extended position wherein opening 268 is once again in communication with circular slot 242. Whenever so arranged, the cam surface member 172 will be free to exit the yoke member 266 as it is subsequently indexed to discharge station D. Also, the gripper jaws 164 of chuck assembly 150 will once again contact nose-piece 148. As piston rod 264 reaches the end of its return stroke to the upward position the actuating finger 272 of the microswitch 260, which had been by-passed when the piston rod moved downwardly, will now enable the conventional one-way microswitch 260 to be energized. As a result thereof, the switch 260 through its operative electrical connection with the conventional control system 274 enables actuation of the fluid motor 188 of drive means 46. It, of course, being emphasized that the microswitches 238 and 260 are suitably associated with the control system 274 in a conventional manner so as to enable the aforedescribed operation.

Specifically referring to FIGS. 17 and 18, fluidic energization of fluid motor 188 acts to retract piston rod 190. In this manner, the rack 192 will move from its normal or rest position, as shown in FIG. 18, to the retracted position indicated in FIG. 17. As this occurs, the rack 192 rotates pinion 194 clockwise. With this rotational displacement, drive pawl means 196 and knocker member 218 are, likewise, rotated in the similar direction, until end 232 of knocker member 218 engages stop pawl member 224. Upon this contact, knocker member 218 knocks stop pawl 224 from positive engagement with one of the ratchet teeth 214. Whenever this occurs, the ratchet wheel member 212 is free to be positively indexed to another position. The fluid motor 188 then serves to linearly extend piston rod 190 back to the position shown in FIG. 18. Since the rack 192 is now advancing rightwardly, it will rotatably drive pinion 194 counterclockwise. Accordingly, the drive pawl member 204 engages driving ratchet wheel 212 and thereby drives shaft 134 connected to turret plate 132. Consequently, the rivet holding assembly means 44 connected to turret plate 132 will likewise conjointly advance therewith to their next successive station. The rivet holding assembly means 44 at loading station A will advance towards sensing station B, whereas the rivet holding assembly means 44 at the work station C will correspondingly advance to the discharge station D. This indexed movement of the carriage means 42 continues until the stop pawls 24 engage the opposite side of the ratchet tooth 214 which had been driven by drive pawl 204. Thus, the ratchet wheel 212 and thereby drive shaft 134 are positively stopped at a desired position. Also, the second stop means defined by the adjustable threaded member 234 may be arranged to contact the end of rack 192 at the end of the latter's stroke. Such cooperation will further serve to provide assurance for the proper indexing of carriage means 42 between the successive stations. The microswitch 238, which as earlier indicated is electrically operatively connected to the control system 274, will be contacted by rack 192. As this occurs, such contact will enable the fluid motors 94 and 262 to be again actuated upon depression of foot pedal 276.

With reference to FIGS. 1, 2, 13, and 14, as the turret plate 132 advances, the cam surface member 172 will ride up the rise formed in continuous slot 242, while respective ones of the shell flange 158 will begin riding up the cam surface 244 and causing shell member 146 to be linearly vertically displaced with respect to turret plate 132. At the sensing station B, the microswitch 280 will act to sense for the presence of a rivet 22 protruding from holder assembly means 44. Should a rivet be absent, microswitch 280 will give a signal which may serve to indicate that the rivet is not in holder means 44 and stop further actuation of fluid motor 188 thereby stopping the indexing of the turret plate 132. It, of course, will be understood that such control system 274 will be arranged in a conventional manner with the microswitch 280 so as to enable subsequent actuation of carriage means 46.

At the discharge station D, as perhaps best depicted in FIG. 14, the discharge opening 254 will allow the spent mandrel shank 34 to descent through bore 176. It should, of course, be pointed out that whenever the work holders 44 reach their next successive position the fluid motors 94 and 262 may be operated as indicated earlier to perform their respective functions.

By reason of the aforedescribed rivet setting apparatus and method, the present invention facilitates assembly or production line riveting with a relatively simple yet reliable rivet setting apparatus which has relative few moving parts. Since, as aforenoted, the work support surface 68 is disposed in a generally horizontal plane, an operator of rivet setting apparatus 20 may conveniently set the workpieces 32 to be riveted on the horizontal support surface and hold the same there in proper alignment with relatively little effort, especially in contrast to other known blind rivet setting apparatus. Thus, proper alignment of the workpieces may be maintained through the rivet setting operation with the use of two hands. This feature provides for several distinct advantages. As earlier indicated, the work support surface enables accurate alignment to be easily accomplished, especially whenever there are several workpieces each requiring a specific angular orientation. Moreover, proper alignment can be maintained rather easily even should the workpieces be in different size, shapes, or weights. In addition, the work support surface 68 may be suitably changed to appropriately handle workpieces of varying dimensions. Deep riveting operations, such as one generally U-shaped members, may be quite conveniently accomplished by merely removing the horizontal support member 68 and placing such U-shaped members directly on the stationary nose-pieces. It is believed apparent that through the present invention, the riveting operation is speeded up with consequent savings in time, labor, and costs.

While the invention has been described in connection with the foregoing embodiment, it is not intended to limit the invention to the particular form set forth above, but, on the contrary, it is intended to cover such alternatives, modifications, and equivalents as may be included within the spirit and scope of the invention as defined in the appended claims.

What is claimed is:

1. A method for enabling the continuous and automatic setting of blind rivets having a head portion and a mandrel which comprises the steps of feeding individual rivets to respective ones of a plurality of rivet holding assembly means at a loading station, successively and incrementally advancing the rivets in a first predetermined path such that they travel from at least the loading station to a working station, automatically displacing respective ones of the rivet mandrels operatively held by the holding assemblies at the working station in a second predetermined path such that the rivet mandrel is ruptured and the remainder of the rivet is set in the material, and supporting the material to be riveted in a generally horizontal plane at the working station such that the rivet is situated above the plane for enabling insertion into the workpieces.

2. A method particularly adapted for use in enabling the continuous and automatic setting of blind rivets having elongated mandrels in suitably apertured material comprising the steps of:

automatically feeding individual rivets to a plurality of rivet holding assembly means at a loading station;

automatically, successively and incrementally advancing the rivet holding means in a first predetermined path from at least the loading station, whereat at least a portion of the rivet mandrel is received, to a working station, whereat the rivet holding means is displaced, and back again to the loading station, to complete one operation cycle;

automatically imparting generally vertical movement to respective ones of the rivets operatively held by the holding means at the work station such that the rivets will be displaced by a predetermined distance which is sufficient to snap the rivet mandrel to thereby actuate the rivet in the working material; and automatically supporting the material to be riveted in a generally horizontal plane at the working station such that the rivet is situated above the plane for enabling insertion into the workpieces prior to said step of vertically displacing the rivet in the holding means.

3. The method as set forth in claim 2 which further comprises the step of discharging the snapped mandrel after said step of imparting movement to snap the mandrel.

4. The method as set forth in claim 2 which further comprises the step of sensing whether or not the holder means carries a rivet as the holder means is advanced from the loading station to the working station.

5. A method as set forth in claim 2 in which said step of horizontally supporting the material to be riveted further includes the step of supporting the material on a removable horizontal support surface which support surface whenever removed enables generally U-shaped members to be placed on the holder means for facilitating deep riveting operations.

* * * * *